US006417772B2

(12) United States Patent
Right et al.

(10) Patent No.: US 6,417,772 B2
(45) **Date of Patent: *Jul. 9, 2002**

(54) LIFE SAFETY SYSTEM WITH ENERGY SAVING VISUAL ALARM APPLIANCE AND METHOD

(75) Inventors: Robert Right, Holmes Beach; Hilario S. Costa, Sarasota, both of FL (US); Dennis T. Rock, Parkman, ME (US)

(73) Assignee: General Signal Corporation, Muskegon, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/369,622

(22) Filed: Aug. 6, 1999

(51) Int. Cl.[7] ..... G08B 23/00

(52) U.S. Cl. ..... 340/573.1; 340/691.2; 340/326; 340/328; 340/579; 340/584; 340/815.4

(58) Field of Search ..... 340/691.1, 691.2, 340/691.3, 691.4, 691.5, 692, 693.5, 326, 328, 329, 331, 332, 577, 578, 579, 584, 585, 586, 587, 588, 589, 590, 591, 592, 593, 594, 595, 596, 597, 598, 599, 600, 628, 629, 630, 632, 633, 634, 815.4, 384.1, 384.4, 384.71, 401.1, 321, 573.1

(56) References Cited

U.S. PATENT DOCUMENTS

| | | | | | |
|---|---|---|---|---|---|
| 4,477,796 | A | * | 10/1984 | Kearsley | 340/105 |
| 5,189,455 | A | * | 2/1993 | Seim | 340/331 |
| 5,559,492 | A | * | 9/1996 | Stewart et al. | 340/331 |
| 5,659,287 | A | | 8/1997 | Donati et al. | |
| 5,751,210 | A | * | 5/1998 | Kosich | 340/293 |

* cited by examiner

*Primary Examiner*—Jeffery Hofsass
*Assistant Examiner*—Daniel Previl
(74) *Attorney, Agent, or Firm*—Baker & Hostetler L.L.P.

(57) ABSTRACT

A life safety system with a micro-controller that is programmed to operate both a visual signal and an audible signal. One feature of the system is that a user is permitted to enter a temporal signaling mode for not only the audible signal, but also the visual signal. The program includes an energy saving routine that operates the visual signal in the temporal mode with an energy consumption that is substantially smaller than required for operation in a continuous mode. The temporal pattern has four cycles with one flash pulse per cycle for the first three cycles and no flash pulse for the fourth cycle.

2 Claims, 3 Drawing Sheets

LIFE SAFETY SYSTEM WITH ENERGY SAVING VISUAL ALARM APPLIANCE AND METHOD

BACKGROUND OF THE INVENTION

1. Field of the Invention

This invention relates to a life safety system and method that is energy efficient. In particular, the present invention relates to a life safety system and method for controlling a visual signal in an energy efficient manner.

2. Description of the Prior Art

Life safety systems are used in and around buildings to alert people of an emergency event, such as a fire or other event that could cause bodily harm. Generally, a life safety system includes one or more visual signals and/or audible signals that are operated to alert people of an emergency event and guide them along an evacuation route.

It is known to operate a visual signal in a continuous mode in which the visual signal flashes at a rate in the range of about 0.33 to 3 Hz with one flash per cycle. A continuous mode flashing is not very distinctive and may not sufficiently alert a hearing impaired person of impending danger. Also, such visual signals are designed to operate only in the continuous mode. That is, there is no provision for a user to choose another mode.

It is also known to operate an audible signal in either a continuous mode or in a temporal mode. In the continuous mode, the audible signal emits sound bursts at a rate of about 0.33 to 3 HZ with one sound burst per cycle. In the temporal mode, the audible signal operates in a sound pattern of four cycles with one sound burst per cycle for the first three cycles and no sound burst for the fourth cycle. The temporal mode is especially beneficial to the visually impaired person as it provides a distinctive and recognizable warning sound pattern.

It is also known to use one or more micro-controllers to control the operation of visual and/or audible signals. For example, U.S. Pat. No. 5,659,287 to Donati et al. provides a life safety system having a micro-controller that operates a visual signal and/or an audible signal based on program routines. The program routines include the capability of operation in a synchronous mode with other micro-controllers in the life safety system such that visual signals controlled by the micro-controllers all flash substantially in unison. The program routines also operate the audible signal in either a continuous mode or in a three pulse temporal pattern. However, the program routines make no provision for the micro-controller to operate the visual signal and the audible signal in synchronism so that a visual flash and a sound burst occur substantially simultaneously.

Accordingly, there is a need to provide a user of a life safety system with a choice of choosing a mode other than continuous for a visual signal. There is also a need to control the initiation of a visual signal annunciation and an audible signal annunciation so that they appear simultaneous in time to a person who is subjected to both. There is also a need to provide a distinctive visual flash pattern to a hearing impaired person for emergency event situations.

An object of the present invention is to provide a method of operating a visual signal that meets the aforementioned needs.

Another object of the present invention is to provide a life safety system that satisfies the above needs.

SUMMARY OF INVENTION

A method according to the present invention operates a visual signal in a life safety system. The life safety system includes a micro-controller that operates the visual signal to provide a visual alarm signal when an emergency event occurs.

The method determines if a temporal mode is set in the micro-controller. If a temporal mode is set, a flash pulse stream is developed that has a repetitive pattern of four cycles with one flash pulse per cycle for the first three cycles of the pattern and no flash pulse for the fourth cycle of the pattern. The flash pulse stream is then applied to the visual signal. The visual signal flashes in a repetitive pattern that includes four consecutive cycles with a flash occurring in each of the first three cycles of the pattern and no flash occurring in the fourth cycle. This eliminates a need for the visual signal to consume energy during the fourth cycle with the advantage that a smaller and less costly power supply can be used.

In another aspect of the invention, the micro-controller is controlled to cause the visual signal and an audible signal to flash and sound in unison.

A life safety system according to the present invention includes an energy saver program that causes the micro-controller to use the method of the present invention.

BRIEF DESCRIPTION OF DRAWINGS

Other and further objects, advantages and features of the present invention will be understood by reference to the following specification in conjunction with the accompanying drawings, in which like reference characters denote like elements of structure and.

DESCRIPTION OF PREFERRED EMBODIMENT

Figure 1:
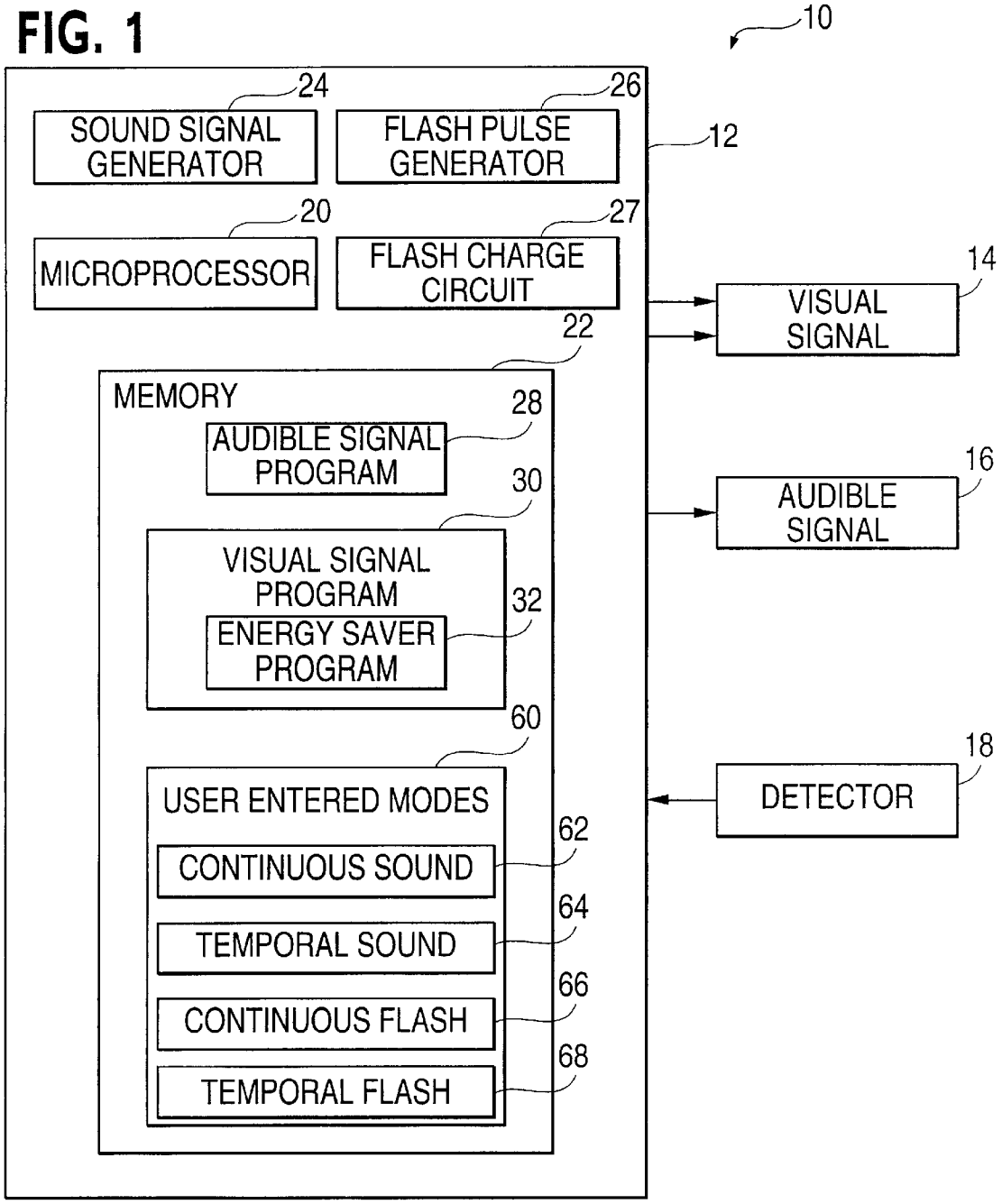
FIG. 1 is a block diagram of a life safety system according to the present invention.

With reference to FIG. 1, there is provided a life safety system generally represented by numeral 10. Life safety system 10 includes a micro-controller 12, a visual signal 14, an audible signal 16 and a detector 18. Micro-controller 12 is coupled with visual signal 14, audible signal 16 and detector 18. When an emergency event is detected by detector 18, micro-controller 12 causes visual signal 14 to flash and audible signal 14 to emit sound bursts.

Visual signal 14 may be any suitable visual signal that can be used in a life safety system for visual annunciation of an emergency event. Preferably, visual signal 14 is a strobe light of the type described in the aforementioned Donati et al. patent. Audible signal 16 may be any suitable audible signal that can be used in a life safety system for audible annunciation of an emergency event. Preferably, audible signal 16 is an electronic horn. Detector 18 may be any suitable detector that detects an emergency event. For example, detector 18 may be a smoke detector.

Micro-controller 12 includes a microprocessor 20, a memory 22, a sound signal generator 24, a flash pulse generator 26 and a flash charge circuit 27. Memory 22 has stored therein a number of programs including an audible signal program 28, a visual signal program 30 as well as a number of user entered modes 60. Other programs also reside in memory 22, such as those described in the aforementioned Donati et al. patent.

Microprocessor 20, upon detection of an emergency event by detector 18, operates under the control of audible signal program 28 to cause sound signal generator 24 to produce a sound signal D that is applied to audible signal 16. Microprocessor 20 also responds to an emergency event detected by detector 18 to operate under the control of visual signal program 30 to cause flash pulse generator 26 to produce a flash pulse stream C that is applied to visual signal 14. Visual signal program 30 also causes flash charging circuit 27 to produce a strobe charge signal B for storing energy in an energy storage device contained in visual signal 14.

User entered modes 60 permit the user of the life safety system 10 to choose either a continuous sound mode 62 or a temporal sound mode 64. In accordance with one aspect of the present invention, the user is given the option of choosing either a continuous flash mode 66 or a temporal flash mode 68. This is a significant choice as the temporal flash mode consumes 25% less energy than the continuous flash mode during an emergency event annunciation. With less energy consumption, the size and cost of the power supply for life safety system 10 can be reduced.

In accordance with the present invention, visual signal program 30 includes an energy saver program 32. Energy saver program 32 directs microprocessor 20 to operate visual signal 14 in the temporal visual mode or in the continuous visual mode.

Figure 2:
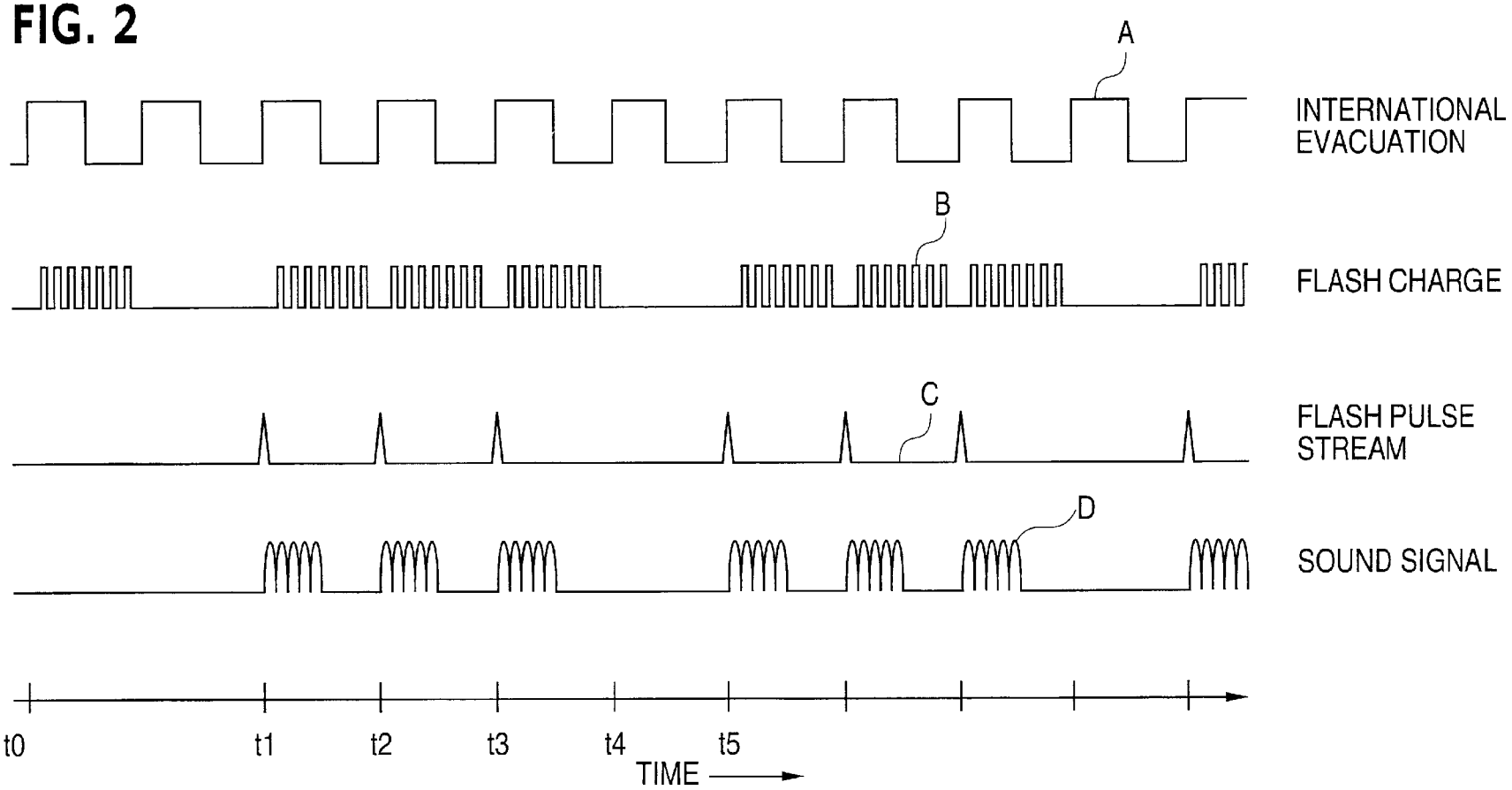
FIG. 2 is a waveform diagram illustrating a temporal flashing according to the present invention.

Referring to FIG. 2, the waveforms begin at a time t0 just after detector 18 detects an emergency event. Waveform A is a square wave that represents a standard international evacuation signal. It has a frequency in the range of about 0.33 to 3 Hz as selected by the user of life safety system 10. Waveform B is the flash charge signal produced by flash charge circuit 27. In one cycle, waveform B contains a sequence of charge pulses that serve to charge the energy storage device of visual signal 14.

Waveform C is the flash pulse stream produced by flash pulse generator 26. Waveform C is a repetitive temporal pattern that has four cycles with one flash pulse per cycle for the first three cycles and no pulse for the fourth cycle of the temporal pattern. For example, the time slice that begins with $t_1$ and ends with $t_5$ illustrates the temporal pattern. During the first three cycles from $t_1$ to $t_4$, there is one flash pulse per cycle. During the fourth cycle from $t_4$ to $t_5$, there is no pulse and no need to provide flash charge pulses to visual signal 14. Visual signal 14 by time $t_4$ is already fully charged by the flash charge pulses provided during the third cycle from $t_3$ to $t_4$. Accordingly, visual signal 14 and flash charge circuit consume 25% less energy than during a continuous mode in which there is one flash pulse per cycle.

Waveform D is the sound signal produced by sound signal generator 24. Waveform D is shown for the temporal sound mode. Waveform C has a sequence of sound bursts that are controlled by microprocessor 20 to occur in unison with the flash pulses of waveform C so that audible signal 16 initiates a sound burst substantially simultaneously with visual signal 14 initiating a flash.

Figure 3:
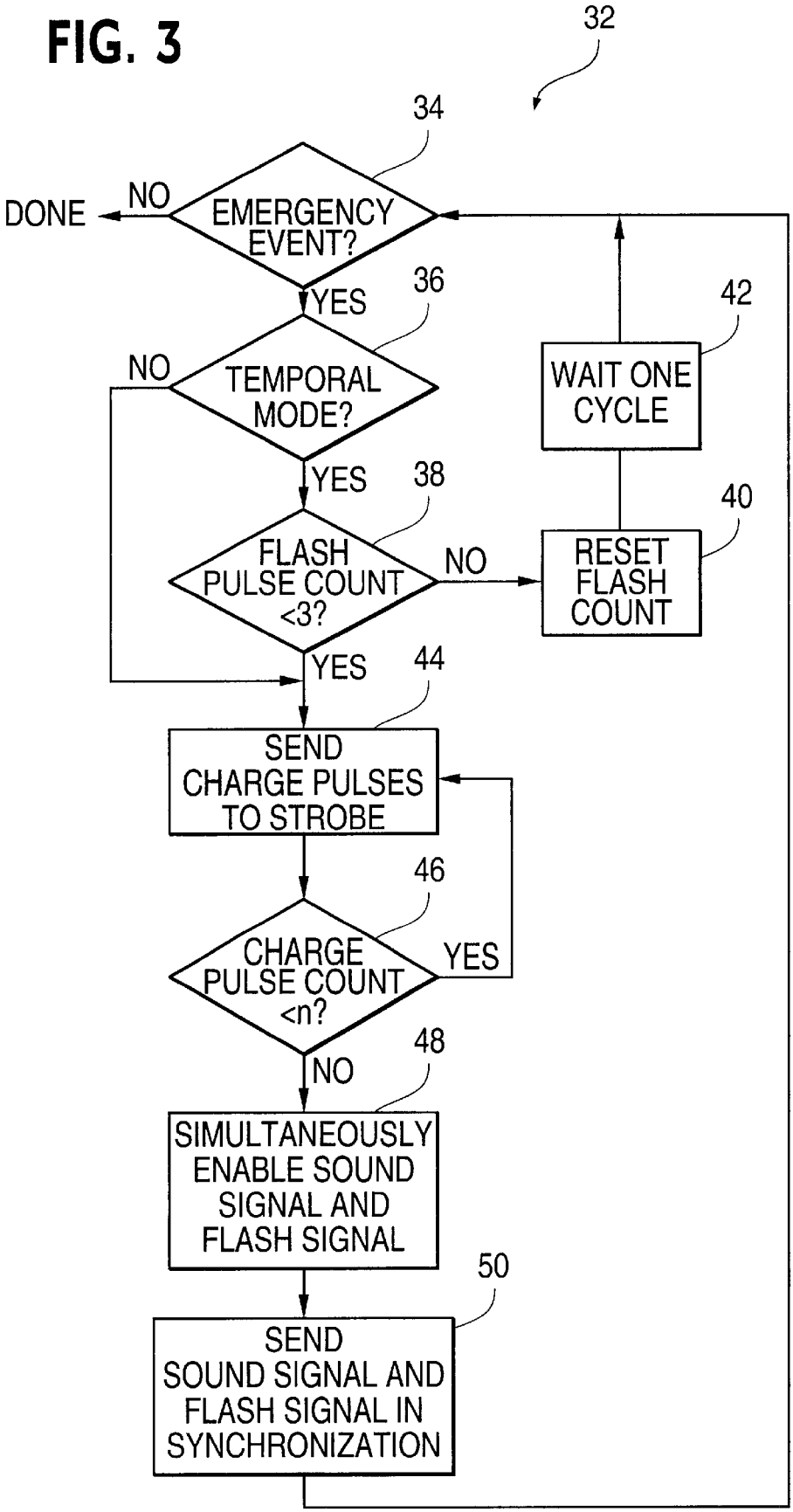
FIG. 3 is a flow diagram of the energy saver program included in the FIG. 1 system.

Referring to FIG. 3, energy saver program 32 begins at a step 34 with an inquiry as to whether an emergency event has been detected by, for example, detector 18, and has not been cleared. If so, a step 36 determines if the temporal flash mode has been set. If so, a step 38 determines if the flash pulse count is less than 3. If so, a step 44 causes flash charge circuit 27 to send flash charge pulses to visual signal 14. A step 46 keeps a count of charge pulses until the count is equal to a number n that represents the number of charge pulses needed to sufficiently charge visual signal 14. A step 48 then enables flash pulse generator 26 to send a flash pulse to visual signal 14 and sound signal generator 24 to send a sound burst signal to audible signal 16. A step 50 then causes the sound burst signal and the flash pulse signal to be sent simultaneously and in synchronization. This causes visual signal 14 to initiate a flash substantially simultaneously with audible signal 16 initiating a sound burst.

Assuming that the emergency event has not been cleared, steps 34 through 38 and 44 through 50 are repeated until step 38 determines that the flash pulse count is not less than three. When the flash count is equal to three, a step 40 resets the flash pulse count. A step 42 then causes a wait or delay of one cycle so that no pulse will be generated for this cycle. Steps 32 through 50 then continue until the emergency event has been cleared or visual program 30 times out the emergency event signaling process with a routine that forms no part of the present invention and, therefore, is not shown in FIG. 3.

If the continuous flash mode 66 is set, steps 38 through 42 are skipped so that the steps 34, 36 and 44 through 50 are performed repetitively until the emergency event has been cleared or visual program 30 times out.

The present invention having been thus described with particular reference to the preferred forms thereof, it will be obvious that various changes and modifications may be made therein without departing from the spirit and scope of the present invention as defined in the appended claims.

What is claimed is:

1. A method of operating a visual signal with a microcontroller in a life safety system to provide a visual alarm signal and to provide an audible signal when an emergency event occurs, said method comprising:

(a) determining if a temporal mode is set in said microcontroller;

(b) developing a flash pulse stream that has a repetitive pattern of a number of cycles with one flash per cycle for the first three cycles and no flash for the fourth cycle of said pattern if said step (a) determines that said temporal mode is set;

(c) applying said flash pulse stream to said visual signal, whereby said visual signal flashes in a repetitive pattern that includes four consecutive cycles with a flash occurring in each of the first three cycles of said pattern and no flash occurring in the fourth cycle of said pattern, thereby eliminating a need for said visual signal to consume energy during said fourth cycle;

(d) if said step (a) determines that said temporal mode is not set, step (b) then develops a flash pulse stream as a continuous stream of pulses, whereby said visual signal flashes with a flash occurring in each cycle;

(e) developing a sound signal;

(f) applying said sound signal to said audible signal in synchronism with said flash pulse stream being applied to said visual signal by step (c), whereby said audible signal initiates an audible sound substantially simultaneously with said visual signal initiating a visual flash during at least three consecutive cycles of said flash pulse stream;

wherein if said step (a) determines that said temporal mode is set, said step (b) further comprises:

(b1) keeping a flash count of said flash pulses;

(b2) determining if said flash count is less than three;

(b3) if said step (b2) determines that said flash count is less than three, developing a flash pulse and incrementing said flash count; and (b4) if said step (b2) determines that said flash count is not less then three, resetting said flash count, waiting one cycle and then repeating said steps (b2) and (b3).

2. The method of claim 1, wherein said repetitive pattern has four equally-spaced cycles.

* * * * *